United States Patent [19]

Granger

[11] 4,290,271

[45] Sep. 22, 1981

[54] NITROGEN LIQUID TO GAS CONVERTER

[75] Inventor: Donald W. Granger, Sunset, La.

[73] Assignee: Waukesha-Pearce Industries, Inc., Houston, Tex.

[21] Appl. No.: 127,620

[22] Filed: Mar. 6, 1980

[51] Int. Cl.[3] ..... F17C 7/02

[52] U.S. Cl. ..... 62/53; 60/618; 60/648

[58] Field of Search ..... 62/52, 53; 60/618, 648

[56] References Cited

U.S. PATENT DOCUMENTS

| | | | |
|---|---|---|---|
| 3,229,472 | 1/1966 | Beers | 62/53 |
| 4,031,705 | 6/1977 | Berg | 60/618 |
| 4,197,712 | 4/1980 | Zwick et al. | 62/53 |

*Primary Examiner*—Ronald C. Capossela
*Attorney, Agent, or Firm*—Fulbright & Jaworski

[57] ABSTRACT

A flameless nitrogen liquid to gas converter for providing high pressure nitrogen as to treat oil and gas wells. A diesel engine prime mover drives hydraulic pumps and motors to pressurize nitrogen and actuate an air fan. Heat for converting the liquid nitrogen to gaseous nitrogen is obtained from the engine jacket water, the engine exhaust, and the hydraulic oil from the hydraulic pumps and motors. Additional heat can be obtained from the hydraulic oil system by increasing the hydraulic system pressure with a hydraulic pressure control valve. At least one of the hydraulic pumps and its driven hydraulic motor is in a hydraulic circuit which includes variable means for increasing the pressure in the hydraulic circuit, a hydraulic oil-air heat exchanger, and a hydraulic oil reservoir. Hydraulic fluid from the other pumps and motors is transmitted through the hydraulic oil-air heat exchanger. The system includes an in-line heat exchange system in series in the air flow from upstream to downstream in the following order: hydraulic oil-air heat exchanger, engine water-heat exchanger, engine exhaust-air heat exchanger, nitrogen-air heat exchanger, and an air suction fan.

10 Claims, 5 Drawing Figures

NITROGEN LIQUID TO GAS CONVERTER

BACKGROUND OF THE INVENTION

It is old to convert liquid nitrogen to gaseous nitrogen to treat and stimulate oil and gas wells. The converter must pump the nitrogen to high pressures, such as 10,000 psi, and heat the liquid nitrogen to convert it to gas. However, the environment around oil and gas wells is frequently hazardous and therefore the use of open flames or high temperatures to convert the liquid to gas is dangerous.

The present invention is directed to a self-contained flameless nitrogen liquid to gas converter which pressurizes the nitrogen and converts it to a gaseous state for use in an oil and gas field environment.

SUMMARY

The present invention is directed to a nitrogen liquid to gas converter having a liquid nitrogen inlet and a nitrogen pump actuated by a hydraulic motor for pressurizing the nitrogen. A nitrogen-air heat exchanger is connected to the nitrogen pump and an air fan passes air over the exchanger for adding heat to the nitrogen and converting the liquid to gaseous nitrogen. Hydraulic pumps actuate the motors and a diesel engine drives the hydraulic pumps. Heat for heating the air and thus the nitrogen is obtained from an engine exhaust-air heat exchanger and an engine water-air heat exchanger positioned in the air stream upstream from the nitrogen heat exchanger. Further heat is obtained from a hydraulic oil-air heat exchanger connected to the hydraulic pumps and motors and positioned in the air upstream from the nitrogen heat exchanger. Additional heat is obtained from means for increasing the pressure in a hydraulic oil circuit for increasing the heat of the hydraulic fluid for heating the nitrogen.

A still further object of the present invention is wherein the means for increasing the heat of the hydraulic fluid is a variable hydraulic pressure control valve which is preferably positioned downstream from a pump.

Still a further object of the present invention is the improvement of obtaining heat from hydraulic fluid in which at least one of the hydraulic pumps and its driven hydraulic motor is in a hydraulic circuit which includes a hydraulic oil-air heat exchanger and variable means for increasing pressure in the hydraulic circuit for increasing the heat of the hydraulic fluid for heating the air and thus heating the nitrogen. Preferably, the hydraulic circuit includes a hydraulic oil reservoir downstream of the hydraulic oil-air heat exchanger. In addition, hydraulic fluid from other pumps and motors may be transmitted through the hydraulic oil-air heat exchanger.

Yet a still further object of the present invention is the provision wherein the heat exchange equipment is axially aligned and positioned in series in the air from the upstream to the downstream in the following order: hydraulic oil-air heat exchanger, engine water-air heat exchanger, engine exhaust-air heat exchanger, nitrogen-air heat exchanger, and the air fan.

Other and further objects, features and advantages will be apparent from the following description of a presently preferred embodiment of the invention, given for the purpose of disclosure and taken in conjunction with the accompanying drawings.

DESCRIPTION OF THE PREFERRED EMBODIMENT

Figure 1:
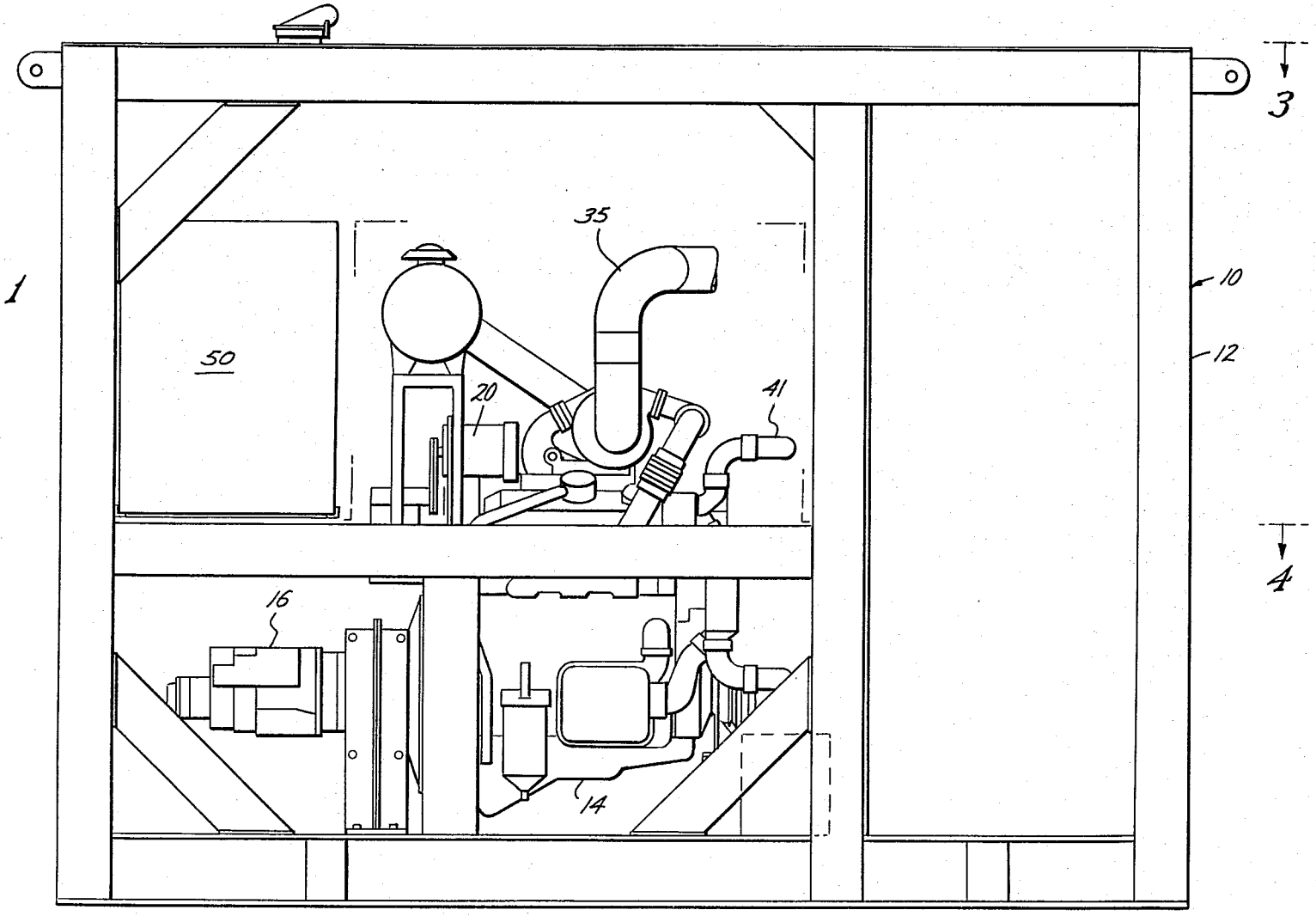
FIG. 1 is a front elevational view of the preferred apparatus of the present invention omitting certain flow lines for convenience.

Referring now to the drawings, and particularly to FIGS. 1–4, the reference numeral 10 generally indicates the nitrogen liquid to gas converter which is mounted on a suitable self-contained support 12 whereby the converter may be suitably transported for treatment of various oil and/or gas wells. A suitable prime mover 14, such as a Detroit diesel engine Model 6V92T is mounted on the support 12 for providing all of the power necessary for the converter 10. A plurality of hydraulic pumps 16, 18 and 20 are mechanically connected to and actuated by the engine 14 which in turn provide the motive force for driving various hydraulic motors for actuating one or more liquid nitrogen pumps and an air fan. Pump 16 may be model 24 sold by Sunstrand, pump 18 may be model 26 sold by Sunstrand, and pump 20 may be model P25X-342 Bert 15-2 sold by Commercial Shearing.

Pump 16 in turn drives a hydraulic motor 22 (FIG. 5), such as Volvo, which in turn drives an air suction fan 24 (FIGS. 2 and 3) which draws air over a nitrogen-air heat exchanger 26 for adding heat to the liquid nitrogen for converting the liquid nitrogen to a gaseous state. Pump 18 drives a hydraulic motor 28, such as model 27 manufactured by Sunstrand, which in turn drives a conventional nitrogen pump 30. The pump 20 drives a hydraulic motor 32, such as model MF 15-3021 manufactured by Sunstrand which in turn drives a conventional liquid nitrogen booster pump 34.

Figure 2:
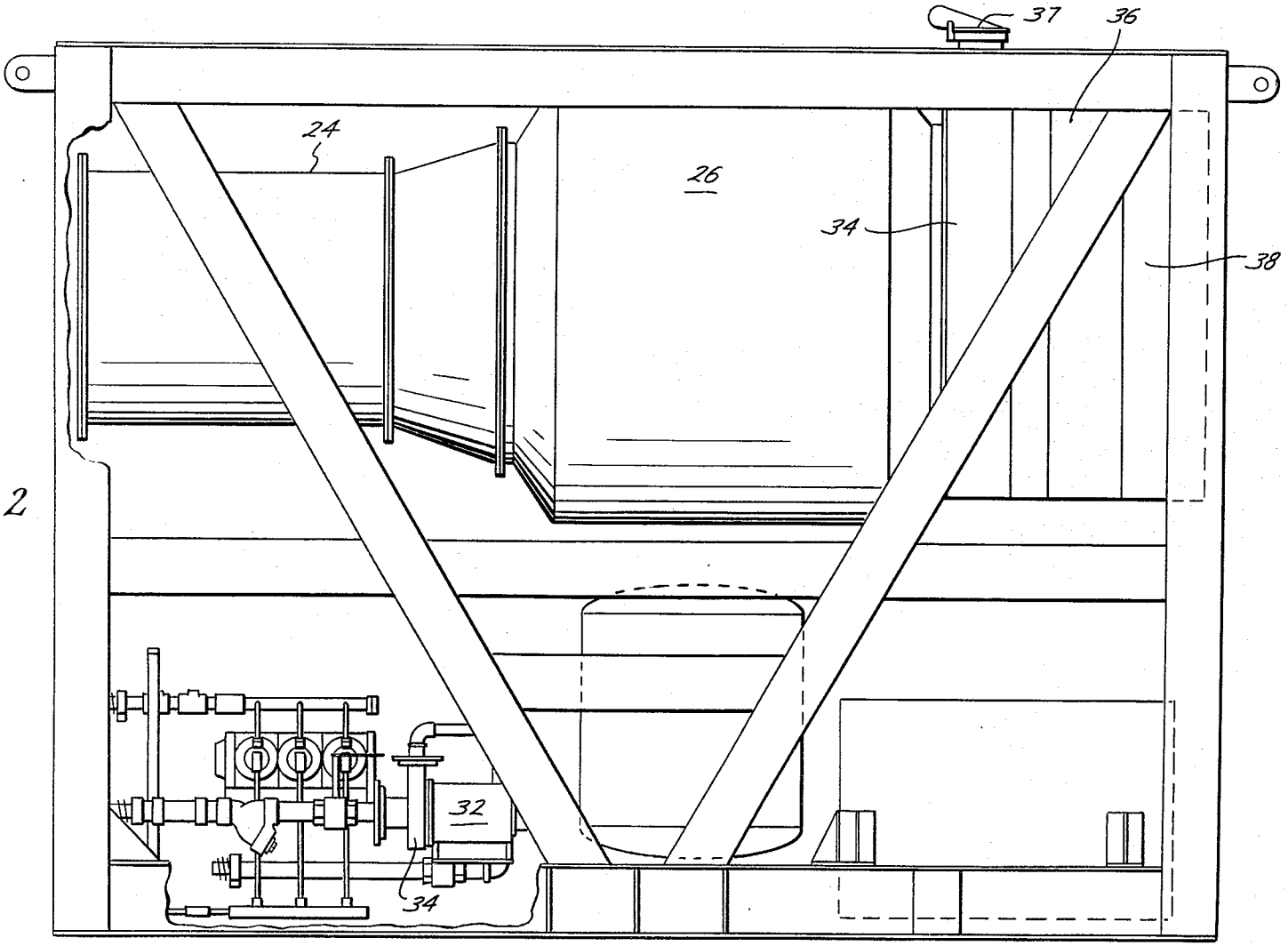
FIG. 2 is a back elevational view of the apparatus of FIG. 1.
Figure 3:
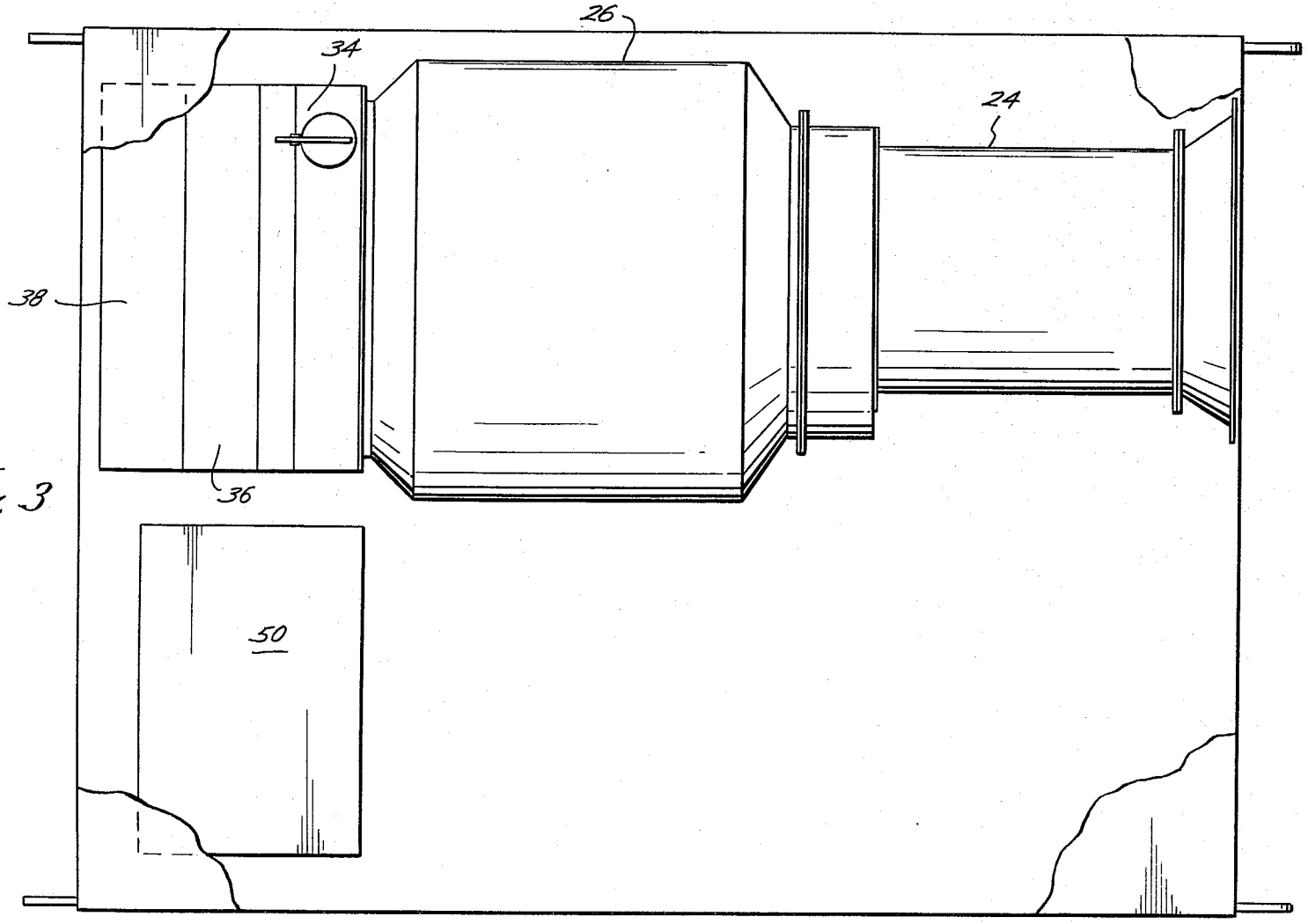
FIG. 3 is a cross-sectional view taken along the line 3—3 of FIG. 1.

Referring now to FIGS. 2 and 3, an engine exhaust-air heat exchanger 34 is positioned in the air stream upstream from the nitrogen heat exchanger 26 for heating the air for assisting in converting the liquid nitrogen to gaseous nitrogen. The engine exhaust 35 (FIG. 1) is covered with insulation (not shown) and is in the heat exchange relationship with the exchanger 34 and the exhaust is then passed through weathercap 37. The heat exchanger 34 thus functions to utilize the waste heat from the exhaust of the diesel engine 14 for heating the nitrogen and additionally reduces the temperature of the exhaust to approximately 75° F. above ambient temperature for preventing the exposure of a high temperature exhaust to the surrounding environment of an oil and/or gas well.

In addition, an engine jacket water exhaust-air heat exchanger 36 is positioned in the air upstream from the nitrogen heat exchanger 26 for providing additional heat for heating the air and converting the liquid nitrogen to gas. The exchanger 36 is connected to the engine cooling water through line 41 (FIG. 1).

In addition, a hydraulic oil-air heat exchanger 38 is connected to various hydraulic pumps and motors, as will be more fully described hereinafter, and is positioned in the air upstream from the nitrogen heat exchanger for still providing additional heat for heating the air and thus the nitrogen. It is to be noted that the air fan 24 and heat exchangers 26, 34, 36 and 38 are coaxially aligned to provide an efficient flow of air by providing a straight flow of the air and maintain uniform air velocity across the surfaces of the heat exchangers 26, 34, 36 and 38. Furthermore, the fan and heat exchangers are positioned in series in the air from upstream to downstream in the following order: hydraulic oil-air heat exchanger 38, engine water-air heat exchanger 36, engine exhaust-air heat exchanger 34, whereby the incoming air stream is heated progressively to higher temperatures for greatest efficiency.

Figure 4:
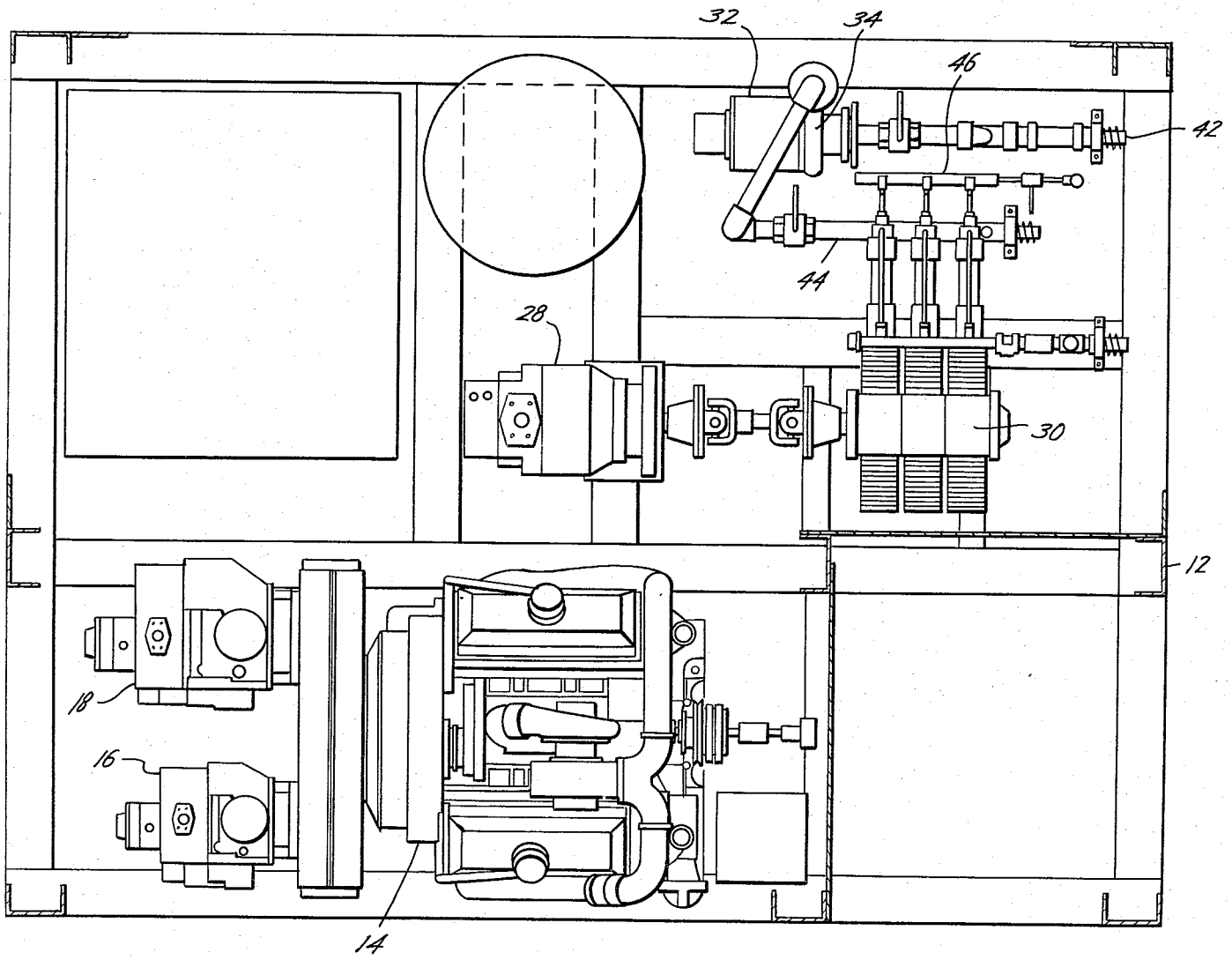
FIG. 4 is a cross-sectional view taken along the line 4—4 of FIG. 1.

Referring to FIG. 4, a liquid nitrogen inlet 42 is provided in communication with the booster pump 34 whereby the liquid nitrogen is pressurized and passed to a supply header 44 for the pump 30 wherein the liquid is further pressurized and passed to a discharge header 46. From the header 46 the pressurized liquid nitrogen is passed to the nitrogen-air heat exchanger 26 where the nitrogen is converted to a gaseous state by the heat exchanged from the flowing air. From the exchanger 26, the gaseous nitrogen is then discharged as required.

Figure 5:
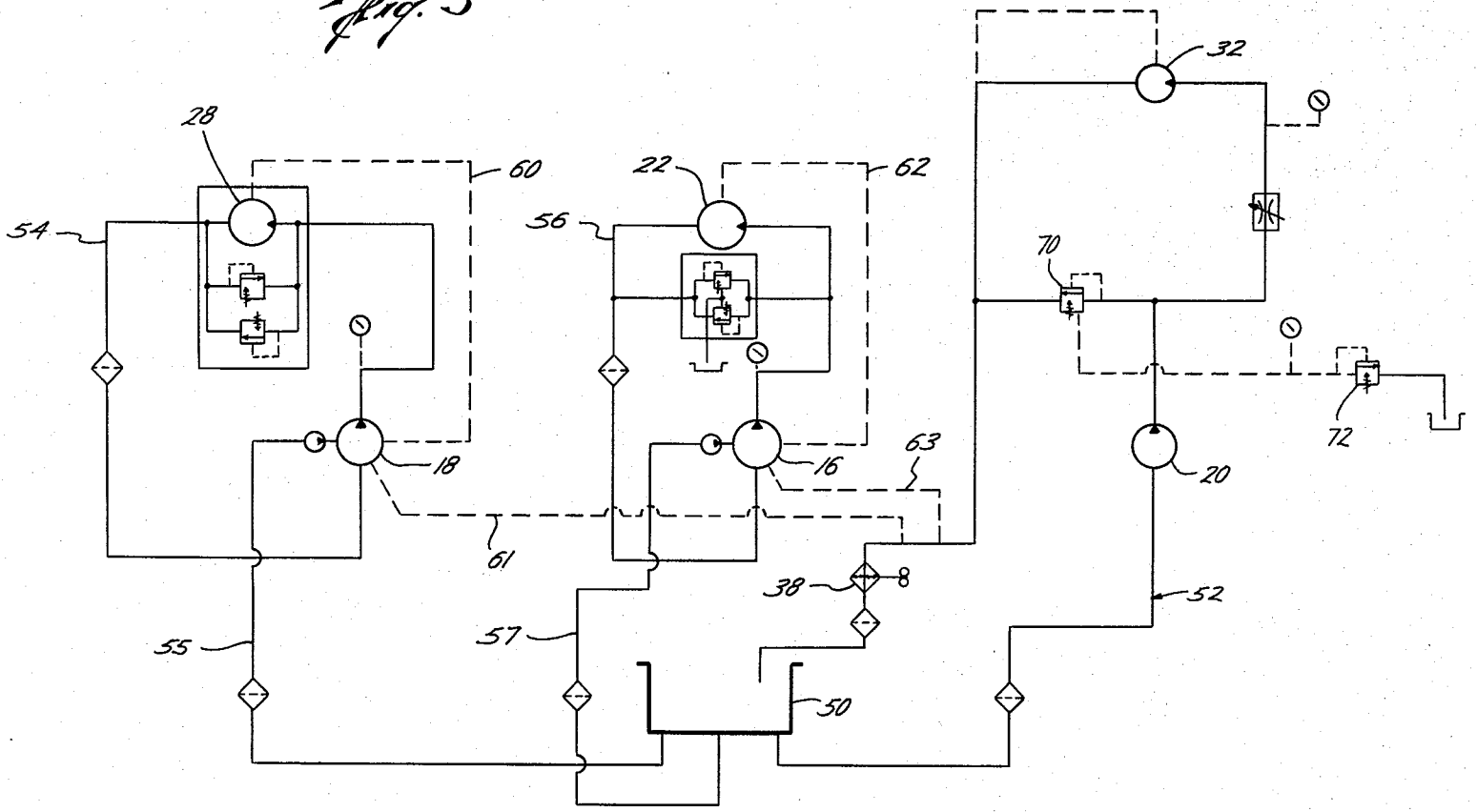
FIG. 5 is a hydraulic schematic of the present apparatus.

Referring now to FIG. 5, a schematic of the hydraulic circuit is best seen. A reservoir 50 of hydraulic fluid is provided for supplying and receiving hydraulic fluid from the circuits. One of the circuits 52 includes the hydraulic pump 20 which supplies fluid to actuate the hydraulic motor 32 which drives the nitrogen booster pump 34. A second hydraulic circuit 54 includes the hydraulic pump 18 which provides hydraulic fluid for actuating the hydraulic motor 28 which drives the nitrogen pump 30. Another hydraulic circuit 56 includes the hydraulic pump 16 which provides fluid for actuating the hydraulic motor 22 which drives the air suction fan.

It is desirable to obtain as much heat from the converter 10 as possible for converting the liquid nitrogen to gas. In addition to obtaining heat from the exhaust and water of the diesel engine 14, heat is extracted from the hydraulic oil of the various hydraulic pumps and motors by virtue of the hydraulic oil-air heat exchanger 38. Thus, the hydraulic fluid in circuit 52 flowing through the pump 20 and motor 32 is transmitted directly through the heat exchanger 38 prior to entering the reservoir 50. On the other hand, circuits 54 and 56 may operate at higher pressures in a closed circuit between the pumps and motors. Makeup fluid for case drain is obtained through makeup lines 55 and 57, respectively. The case drain from motor 28 is transmitted through line 60 and combined with the case drain from pump 18 in line 61 which is then transmitted to the heat exchanger 38. Similarly, the case drain in motor 22 is transmitted by line 62 and combined with the case drain in pump 16 through a line 63 to the heat exchanger 38.

In addition, the present invention includes means for obtaining increased heat from the hydraulic fluid for heating the nitrogen. Preferably, means are provided connected in at least one of the hydraulic circuits for increasing the pressure in the hydraulic circuit thereby increasing the heat of the hydraulic fluid which is transmitted to the hydraulic oil-air heat exchanger for heating the nitrogen. Thus, referring to circuit 52, a variable means for increasing the pressure in the hydraulic circuit such as a relief valve 70, such model P8819-06 from Rivett Company, is provided which can provide a variable restriction in the circuit 52 causing the pump 20 to work at greater pressures and thereby creating extra heat in the hydraulic fluid if the pressure is increased sufficiently by the valve 70. Valve 70 is controlled through control line 37 by manually actuated pressure control valve 72. Therefore, by merely adjusting the pressure control valve 72, valve 72 is controlled so that additional heat may be supplied for heating the nitrogen without providing any dangerous spark igniting means in the hazardous environment surrounding the oil and/or gas well.

Therefore, the present invention provides a liquid to gas nitrogen converter which is self-contained, has a single prime mover and utilizes the waste heat of the diesel engine including both its cooling water and exhaust, and further utilizes the heat from the hydraulic oil system of the various pumps and motors and is able to create additional heat from the hydraulic circuits for converting the liquid to gas, all without danger to the hazardous surroundings of an oil and gas well.

The present invention, therefore, is well adapted to carry out the objects and attain the ends and advantages mentioned as well as others inherent therein. While a presently preferred embodiment of the invention is given for the purpose of disclosure, numerous changes in the details of construction and arrangement of parts may be made which readily suggest themselves to those skilled in the art and which are encompassed within the spirit of the invention and the scope of the appended claims.

What is claimed is:

1. A nitrogen liquid to gas converter comprising,
- a liquid nitrogen inlet,
- a nitrogen pump actuated by a first hydraulic motor connected to the inlet for pumping liquid nitrogen,
- a nitrogen-air heat exchanger connected to the nitrogen pump for adding heat to the nitrogen and converting the liquid nitrogen to gaseous nitrogen,
- an air fan for passing air over the heat exchanger and actuated by a second hydraulic motor,
- hydraulic pump means for actuating the first and second motors,
- diesel engine for driving said hydraulic pump means,
- an engine exhaust-air heat exchanger positioned in the air upstream from the nitrogen heat exchanger for heating the air,
- an engine water-air heat exchanger positioned in the air upstream from the nitrogen heat exchanger for heating the air,
- a hydraulic oil-air heat exchanger connected to the hydraulic pump means and first and second hydraulic motors and positioned in the air upstream from the nitrogen heat exchanger for heating the air,
- means connected to the hydraulic pump means for increasing the heat of the hydraulic fluid for heating the nitrogen.

2. The apparatus of claim 1 wherein the means for increasing the heat of the hydraulic fluid is a hydraulic pressure control valve.

3. The apparatus of claim 2 wherein the control valve is positioned downstream from the pump means.

4. The apparatus of claim 1 wherein the hydraulic oil-air heat exchanger, the engine water-air heat exchanger, the engine exhaust-air heat exchanger, the nitrogen-air heat exchanger, and the air fan are axially aligned.

5. The apparatus of claim 4 wherein the fan and heat exchangers are positioned in series in the air from upstream to downstream in the following order: hydraulic oil-air heat exchanger, engine water-air heat exchanger, engine exhaust-air heat exchanger, nitrogen-air heat exchanger, and the air fan.

6. In a nitrogen liquid to gas converter having a diesel engine prime mover in which the heat rejection of the engine water and engine exhaust are utilized to convert liquid nitrogen to the gaseous state, a plurality of hydraulic pumps driven by the diesel engine, each of the pumps separately driving a hydraulic motor, one of the motors driving a nitrogen pump and another of said motors driving an air fan for passing air over a nitrogen-air heat exchanger, the improvement of obtaining heat from hydraulic fluid comprising, at least one of the hydraulic pumps and hydraulic motor being in a hydraulic circuit which includes a hydraulic oil-air heat exchanger and a variable means for increasing the pressure in the hydraulic circuit for increasing the heat of the hydraulic fluid for heating the air and thus heating the nitrogen.

7. The apparatus of claim 6 wherein the means includes a hydraulic flow control valve.

8. The apparatus of claim 7 wherein the valve is positioned downstream from said one pump.

9. The apparatus of claim 6 wherein the hydraulic circuit includes a hydraulic oil reservoir downstream of the hydraulic oil-air heat exchanger.

10. The apparatus of claim 6 wherein hydraulic fluid from the other pumps and motors is transmitted through the hydraulic oil-air heat exchanger.

* * * * *